US008590451B2

(12) United States Patent
Ballreich et al.

(10) Patent No.: US 8,590,451 B2
(45) Date of Patent: Nov. 26, 2013

(54) METHOD AND APPARATUS FOR FEEDING PRINTING PLATES

(75) Inventors: Christian Ballreich, Waghäusel (DE); Carsten Kelm, Ketsch (DE); Thomas Krüger, Bensheim (DE); Dirk Schönmann, Schifferstadt (DE); Günter Stephan, Bensheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 473 days.

(21) Appl. No.: 12/701,716

(22) Filed: Feb. 8, 2010

(65) Prior Publication Data

US 2010/0229747 A1 Sep. 16, 2010

(30) Foreign Application Priority Data

Mar. 13, 2009 (DE) ..... 10 2009 013 172

(51) Int. Cl.
*B41F 27/12* (2006.01)

(52) U.S. Cl.
USPC ..... 101/477; 101/415.1

(58) Field of Classification Search
USPC ..... 101/415.1, 477
See application file for complete search history.

(56) References Cited

U.S. PATENT DOCUMENTS

| | | | | |
|---|---|---|---|---|
| 5,331,892 | A | 7/1994 | Seib et al. | |
| 5,537,926 | A | 7/1996 | Beisel et al. | |
| 5,758,578 | A | 6/1998 | Metrope | |
| 7,409,908 | B2 | 8/2008 | Zuber | |
| 8,042,468 | B2 | 10/2011 | Kündgen et al. | |
| 2002/0066384 | A1 * | 6/2002 | Deshefi et al. | 101/477 |
| 2005/0016403 | A1 * | 1/2005 | Becker et al. | 101/477 |
| 2008/0282920 | A1 * | 11/2008 | Greive et al. | 101/477 |

FOREIGN PATENT DOCUMENTS

| | | | |
|---|---|---|---|
| CN | 1071368 | A | 4/1993 |
| CN | 1143015 | A | 2/1997 |
| DE | 19511075 | A1 | 9/1996 |
| DE | 10039281 | A1 | 3/2001 |
| DE | 10001319 | A1 * | 7/2001 |
| DE | 202008015082 | U1 | 1/2009 |
| EP | 0570702 | A1 | 11/1993 |
| EP | 0734861 | A1 | 10/1996 |

OTHER PUBLICATIONS

German Search Report dated Oct. 23, 2009.

* cited by examiner

*Primary Examiner* — Ren Yan
(74) *Attorney, Agent, or Firm* — Laurence A. Greenberg; Werner H. Stemer; Ralph E. Locher

(57) ABSTRACT

A method and an apparatus for feeding printing plates to a plate cylinder of a printing press, load the printing plate in the vicinity of its front edge with a curvature which extends convexly with regard to the plate cylinder axis.

10 Claims, 6 Drawing Sheets

METHOD AND APPARATUS FOR FEEDING PRINTING PLATES

CROSS-REFERENCE TO RELATED APPLICATION

This application claims the priority, under 35 U.S.C. §119, of German Patent Application DE 10 2009 013 172.8, filed Mar. 13, 2009; the prior application is herewith incorporated by reference in its entirety.

BACKGROUND OF THE INVENTION

Field of the Invention

The invention relates to a method and an apparatus for feeding printing plates to a cylinder of a printing press, in particular to a plate cylinder.

During changing of a printing plate, in particular during feeding of a new or used printing plate to a plate cylinder of a printing press, the contact of the printing plate on the periphery of the plate cylinder is of great significance for the print quality.

There is the problem that deformations, inhomogeneous stress distributions and unevennesses, which cannot be avoided completely in the feeding and clamping process, can be produced by the clamping operation of the printing plate onto the plate cylinder surface. As a result, the register qualities which can be achieved, in particular the reproducibility of the plate clamping operation and the quality of the multiple color overprinting, can be reduced.

European Patent EP 0 570 702 B2, corresponding to U.S. Pat. No. 5,331,892, has disclosed an apparatus for feeding printing plates to a plate cylinder of a printing press having a holding apparatus for a printing plate, which is disposed pivotably on a printing unit. The plate cylinder is mounted in the printing unit and has respective clamping rails for receiving a front edge of the printing plate and a rear edge of the printing plate.

As a result of a pivoting movement of a lower part of the printing plate holding apparatus, the printing plate is given a curvature which extends transversely with respect to the format width of the printing plate and is directed with its concave side toward the plate cylinder. In that case, the front edge of the printing plate is oriented parallel to the rotational axis of the plate cylinder.

SUMMARY OF THE INVENTION

It is accordingly an object of the invention to provide a method and an apparatus for feeding a printing plate to a plate cylinder, which overcome the hereinafore-mentioned disadvantages of the heretofore-known methods and apparatuses of this general type in such a way that the printing plate can be attached onto the plate cylinder without stress.

With the foregoing and other objects in view there is provided, in accordance with the invention, a method for feeding printing plates to a plate cylinder of a printing press. The method comprises feeding a front edge of a printing plate to a clamping device of the plate cylinder for the front edge of the printing plate, and applying a curvature extending convexly relative to an axis of the plate cylinder to the printing plate in vicinity of the front edge of the printing plate before closing the clamping device for the front edge of the printing plate.

With the objects of the invention in view, there is also provided an apparatus for feeding a printing plate to a plate cylinder of a printing press. The apparatus comprises a pivotably disposed guiding device having a first guiding region shaped convexly relative to an axis of the plate cylinder.

It is particularly advantageous if the front edge of the printing plate is fed to the plate cylinder with a convex curvature which extends transversely with respect to the feeding direction of the printing plate, in which the side edges of the printing plate are close to the plate cylinder while the center of the printing plate is spaced apart somewhat more from the plate cylinder. As a result of this measure, the printing plate can be relieved or stress during closing of the clamping device at the front edge of the printing plate and likewise during further attachment of the printing plate on the plate cylinder.

The measure of giving the printing plate a concave curvature which is opposed to the convex curvature of the front edge in a region which is spaced apart from the front edge is particularly advantageous, that is to say the printing plate has a curvature in this region, which curvature is deflected concavely transversely with respect to the sheet transport direction and is thus opposed to the convex curvature at the front edge of the sheet.

In one advantageous configuration, the feed device has guiding elements, for example rotatably mounted guiding rollers, which are spaced apart next to one another transversely with respect to the printing plate feeding direction and are disposed at different height levels with regard to a feed plane, with the result that the printing plate can be given the desired concave and convex curvatures.

The extent of the curvature can be set by an adjustable height of the guiding rollers in relation to the guiding plane.

Other features which are considered as characteristic for the invention are set forth in the appended claims.

Although the invention is illustrated and described herein as embodied in a method and an apparatus for feeding printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
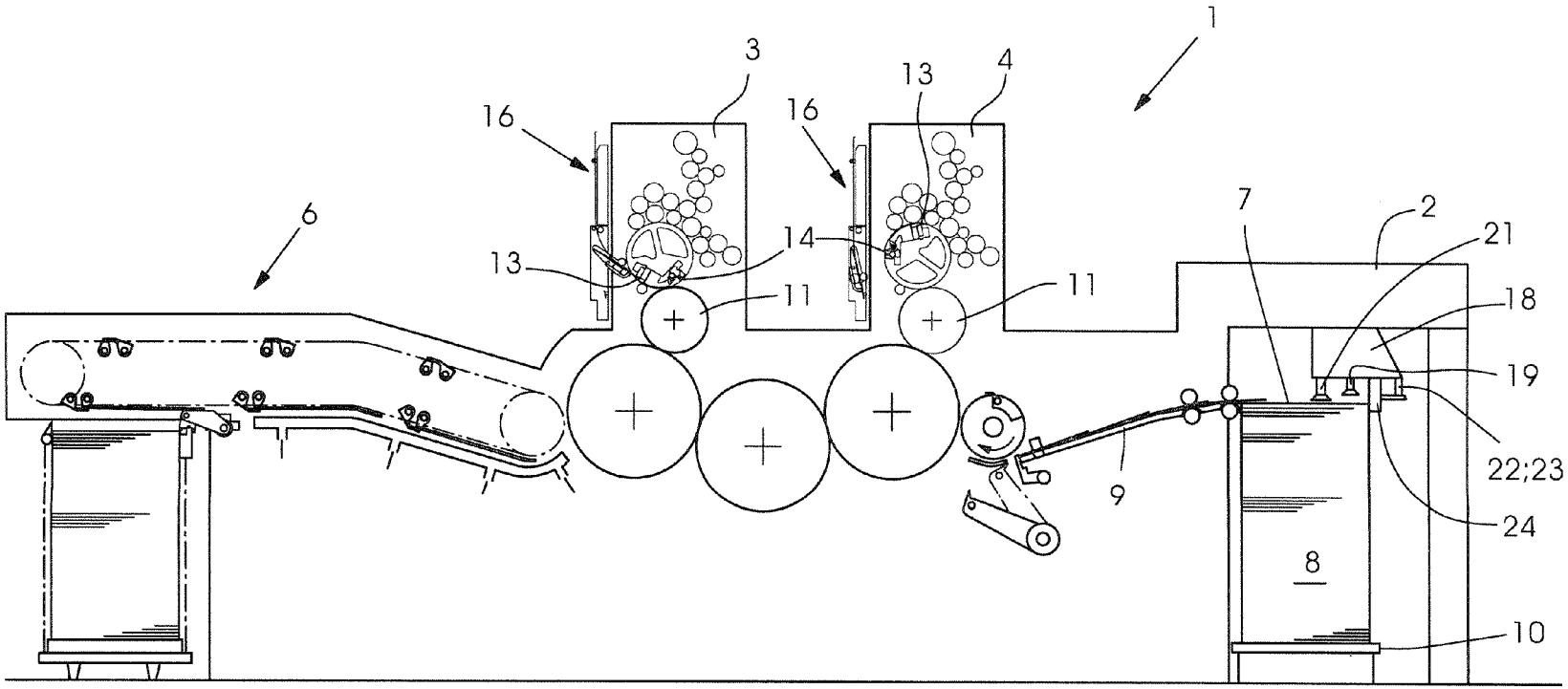
FIG. 1 is a diagrammatic, longitudinal-sectional view of a sheet-fed rotary printing press.

Referring now to the figures of the drawings in detail and first, particularly, to FIG. 1 thereof, there is seen a machine, for example a printing press 1, which processes sheets 7 and has a feeder 2, at least one printing unit 3, 4 and a delivery 6. The sheets 7 are removed from a sheet stack 8 and are fed, individually or overlapping, over a feed table 9 to the printing units 3, 4. The printing units 3, 4 each contain a respective plate cylinder 11, in a known manner. The plate cylinders 11 have respective apparatuses 13, 14 for fastening flexible printing plates. Moreover, each plate cylinder 11 is assigned an apparatus 16 for semi-automated or fully automated printing plate changing.

The sheet stack 8 rests on a stack board 10 which can be raised in a controlled manner. The sheets 7 are removed from the upper side of the sheet stack 8 through the use of a so-called suction head 18 which has, inter alia, a number of lifting and dragging suckers 19, 21 to separate the sheets 7. Moreover, blowing devices 22 are provided for loosening the upper sheet layers and sensing elements 23 are provided for stack tracking. A number of lateral and rear stops 24 are provided for aligning the sheet stack 8, in particular the upper sheets 7 of the sheet stack 8.

Figure 2:
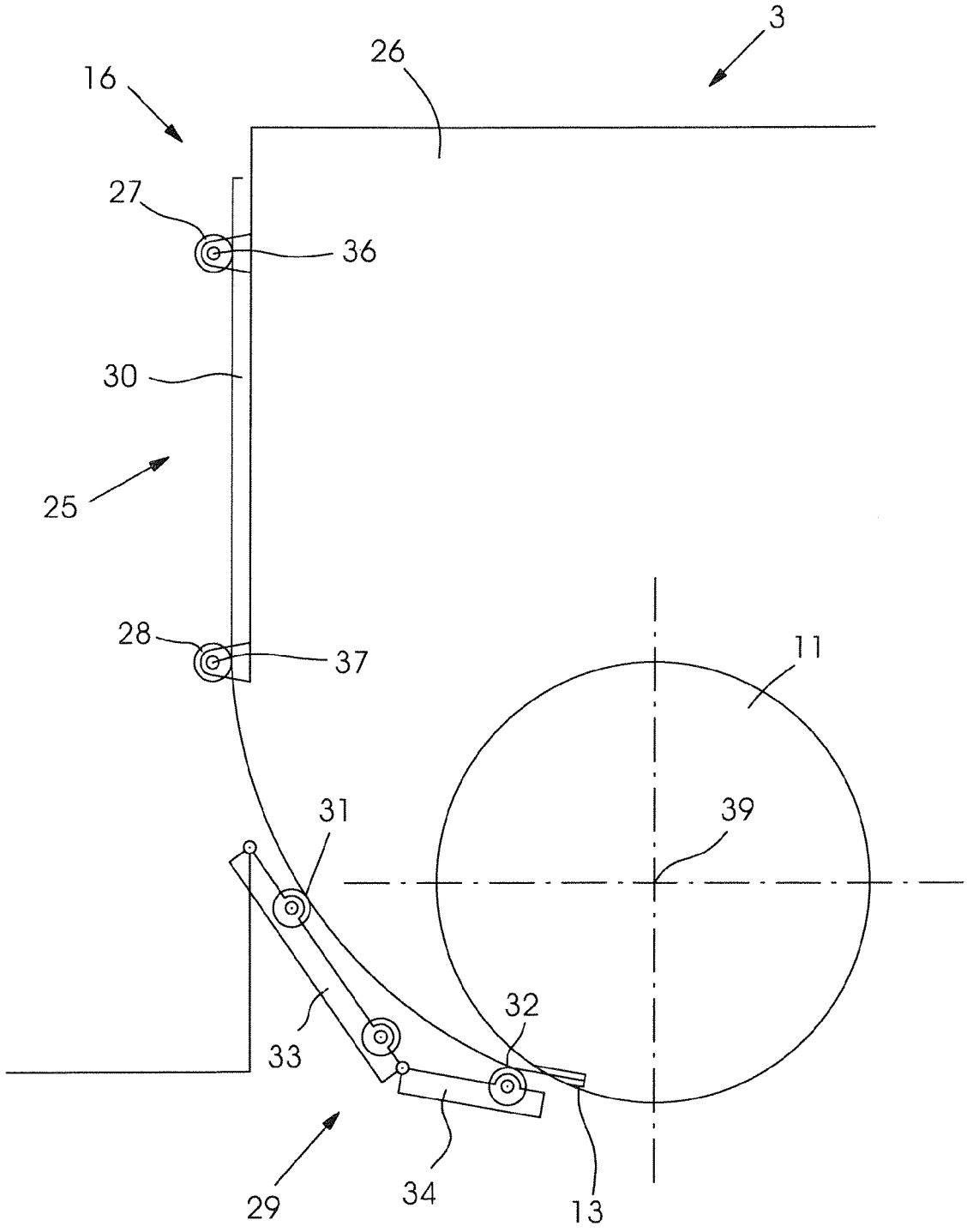
FIG. 2 is an enlarged, fragmentary, sectional view of a printing plate changing device.

In the exemplary embodiment according to FIG. 2, the printing plate changing apparatus 16 is disposed in front of the printing unit 3 and has an upper part 25 with guiding elements 27, 28 which are disposed in a stationary manner on a machine frame 26 of the printing press 1 or on a non-illustrated protective device and are preferably configured as guiding rollers. The guiding elements 27, 28 support the rear region of a printing plate 30 during preliminary positioning outside the plate cylinder 11. A lower part 29 of the printing plate changing apparatus 16 is mounted in such a way that it can be pivoted in the direction of the plate cylinder 11 out of a waiting position into a printing plate feeding position. The lower part 29 has at least two guiding elements 31, 32 for the printing plate. The guiding element 31 is disposed on a carrier 33 which is connected in an articulated manner to a carrier 34 which carries the guiding element 32.

The guiding elements 27, 28; 31, 32 each include, for example, a respective number of rotatably mounted guiding rollers which are spaced apart next to one another transversely with respect to a printing plate feeding direction.

The guiding rollers 27, 28 of the upper part 25 of the printing plate changing apparatus 16 define a straight feed plane for the printing plate 30, in particular for the rear region of the printing plate. In this case, the guiding rollers 27, 28 have, for example, the same diameter D and are each disposed on a respective rotational axis 36; 37.

Figure 3:
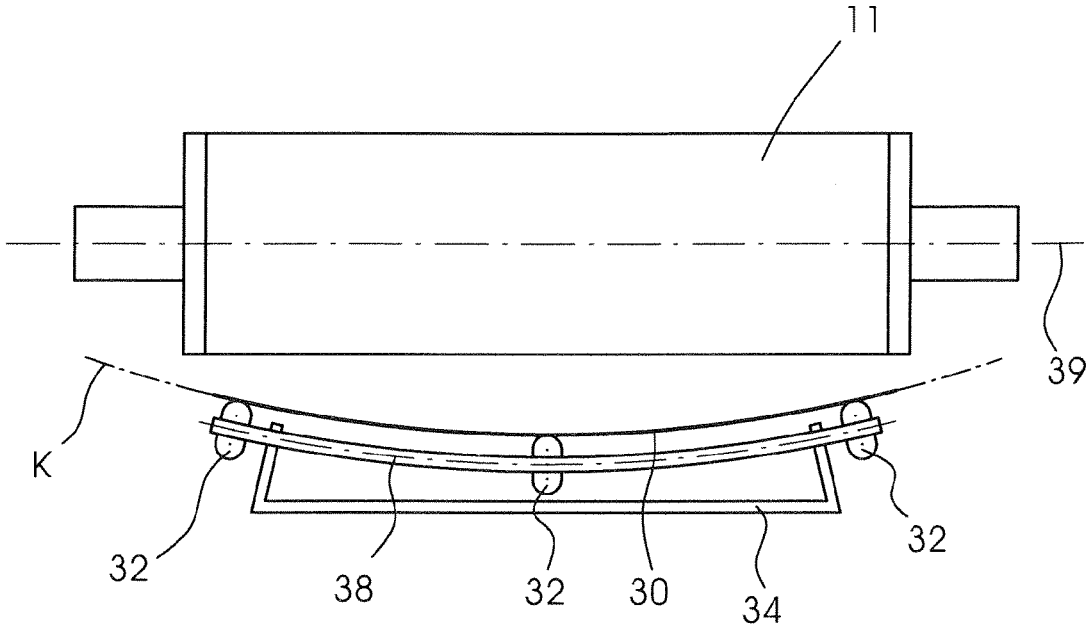
FIG. 3 is a longitudinal-sectional view of a convexly-shaped feed plane.

The guiding rollers 32, which are disposed on the carrier 34 and face the plate cylinder 11, define a concavely curved guiding region K in relation to the guiding device (29, 34) for the front edge of the printing plate. This is due to the guiding rollers 32 according to FIG. 3 being disposed on a concavely bent rotational axis 38. As a result of this measure, the front edge of the printing plate has a convex deflection in relation to a rotational axis 39 of the plate cylinder 11.

Figure 4:
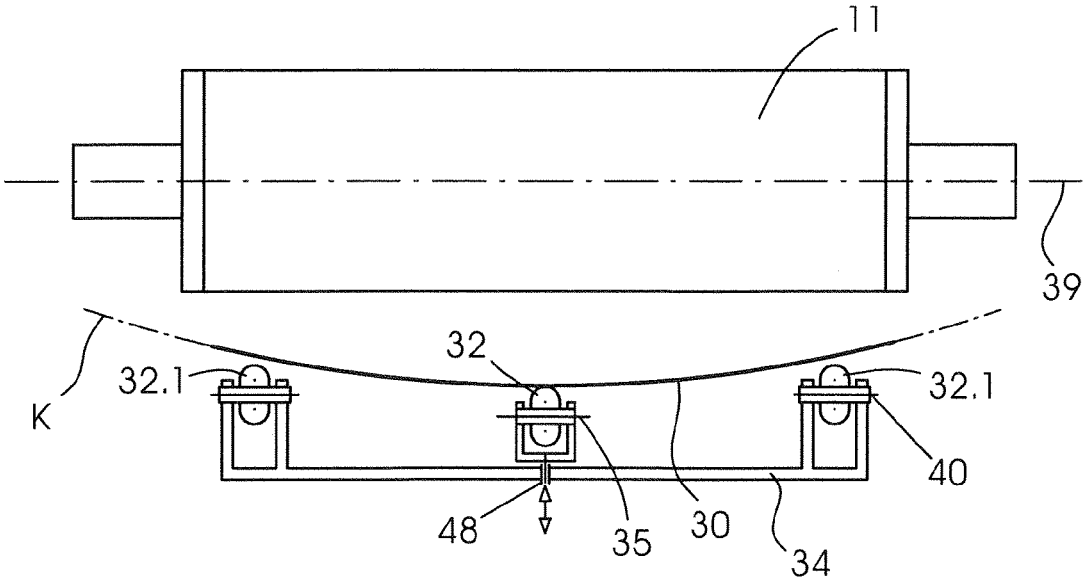
FIG. 4 is a longitudinal-sectional view of the convexly-shaped feed plane with guiding rollers which are disposed in such a way that their height can be adjusted.

In one exemplary embodiment according to FIG. 4, the guiding rollers 32 have identical diameters D, but are disposed on different rotational axes 35, 40. In this case, the guiding roller 32, which is disposed in a central region, is disposed on the rotational axis 35 which is at a greater spacing from the plate cylinder 11 than the rotational axis 40, on which guiding rollers 32.1 in a lateral region are disposed.

The guiding rollers 31, which are disposed on the carrier 33, define a convexly curved guiding region L in relation to the guiding device (29, 33) for those regions of the printing plate 30 which come into contact with the guiding rollers 31.

Figure 5:
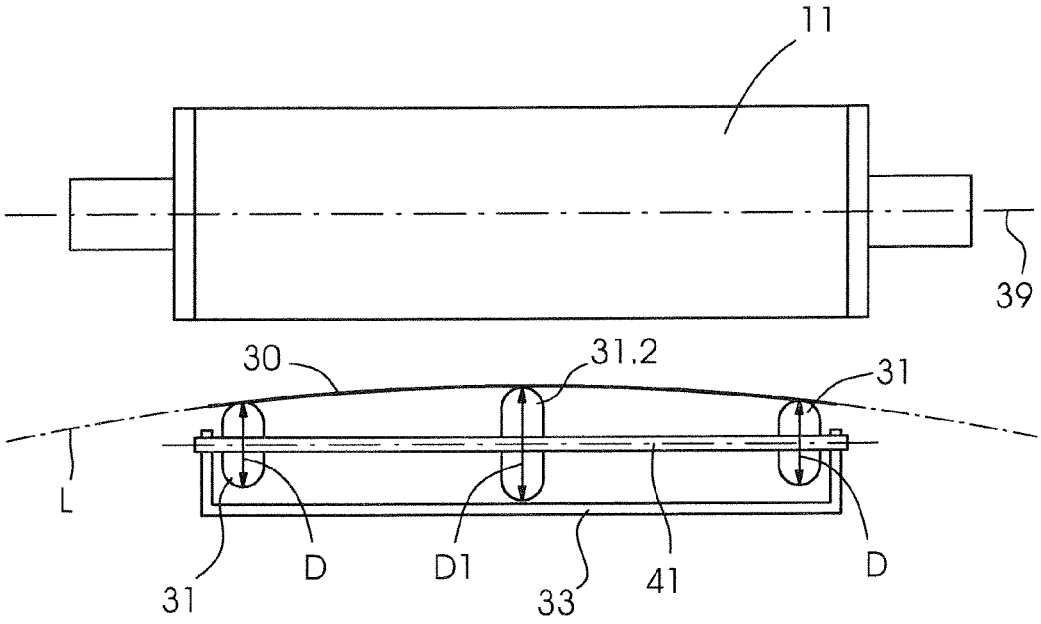
FIG. 5 is a longitudinal-sectional view of a concavely-shaped feed plane with guiding rollers of different diameters.

As a result of this measure, the printing plate is deformed concavely with regard to the cylinder axis 39. According to FIG. 5, the guiding rollers 31 are disposed on a common rotational axis 41, but have different diameters. A diameter D1 of a centrally disposed guiding roller 31.2 is thus greater than a diameter D of the guiding rollers 31 which are disposed in an edge region.

Figure 6:
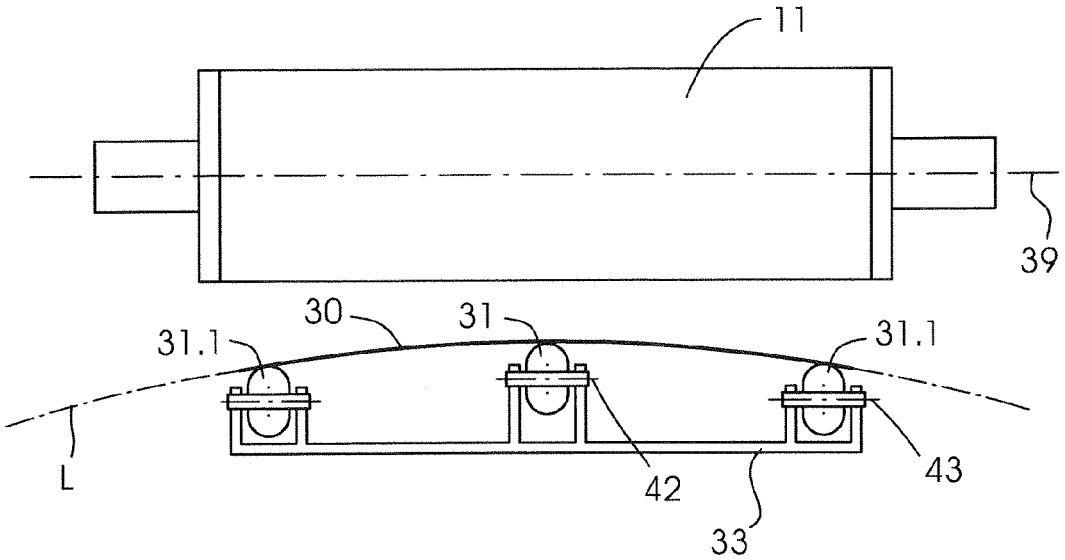
FIG. 6 is a longitudinal-sectional view of the concavely-shaped feed plane.

In one exemplary embodiment according to FIG. 6, the guiding rollers 31 have identical diameters D, but are disposed on different rotational axes 42, 43. In this case, the axis 42 for a centrally disposed guiding roller 31 is disposed at a level which lies above the level of the axis 43 for laterally disposed guiding rollers 31.1.

Figure 7:
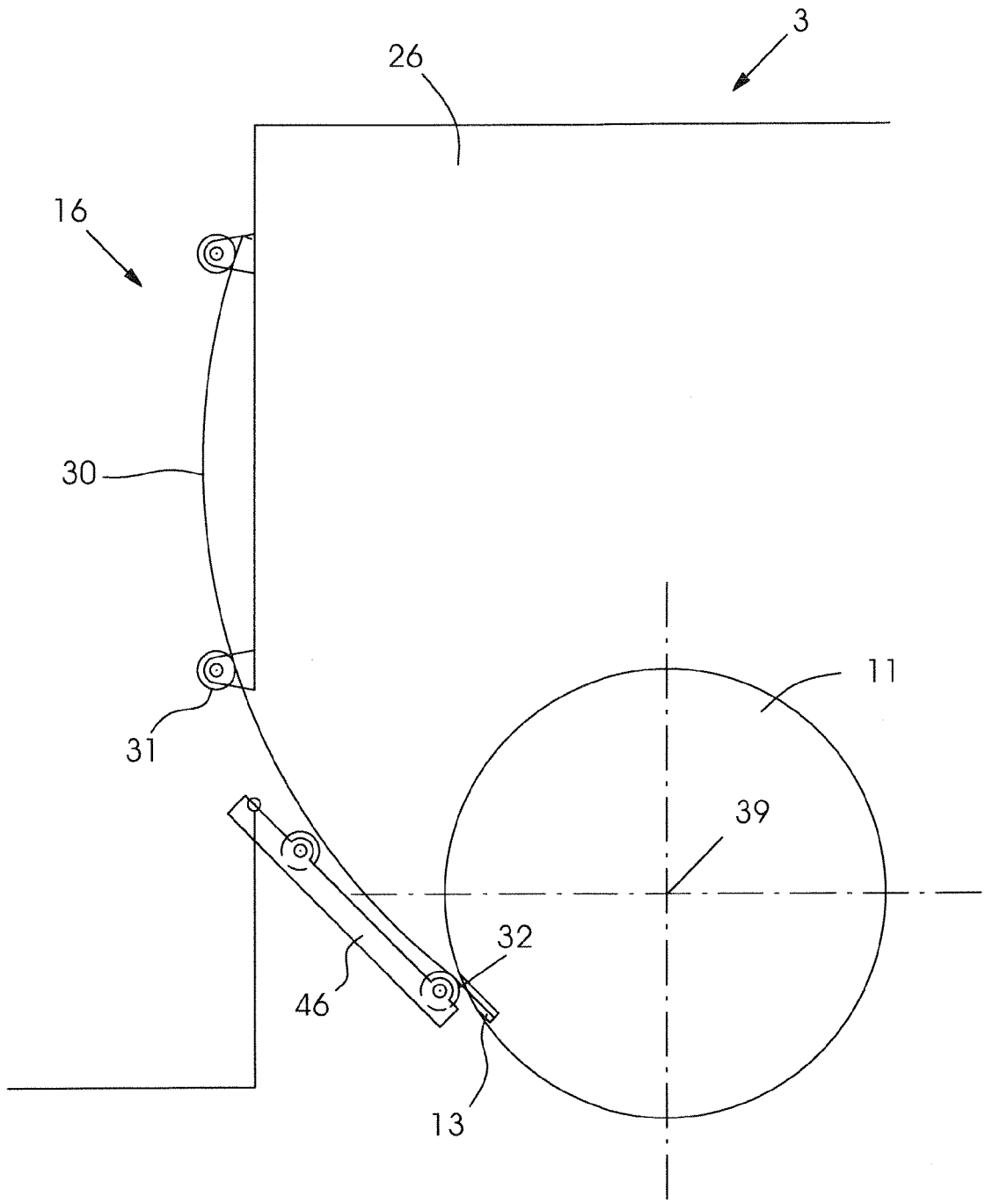
FIG. 7 is an enlarged, fragmentary, sectional view of an alternative printing plate changing device.

In an exemplary embodiment according to FIG. 7, the guiding rollers 31 are disposed in a stationary manner on the machine frame 26 of the printing press 1 in order to produce a concave deformation of the printing plate 30 with regard to the cylinder axis 39 of the plate cylinder. The guiding rollers 32, which are provided for the convex deformation of the printing plate with regard to the plate cylinder axis 39, are disposed at one end, facing the plate cylinder 11, of a single piece, pivotably mounted carrier 46.

Figure 8:
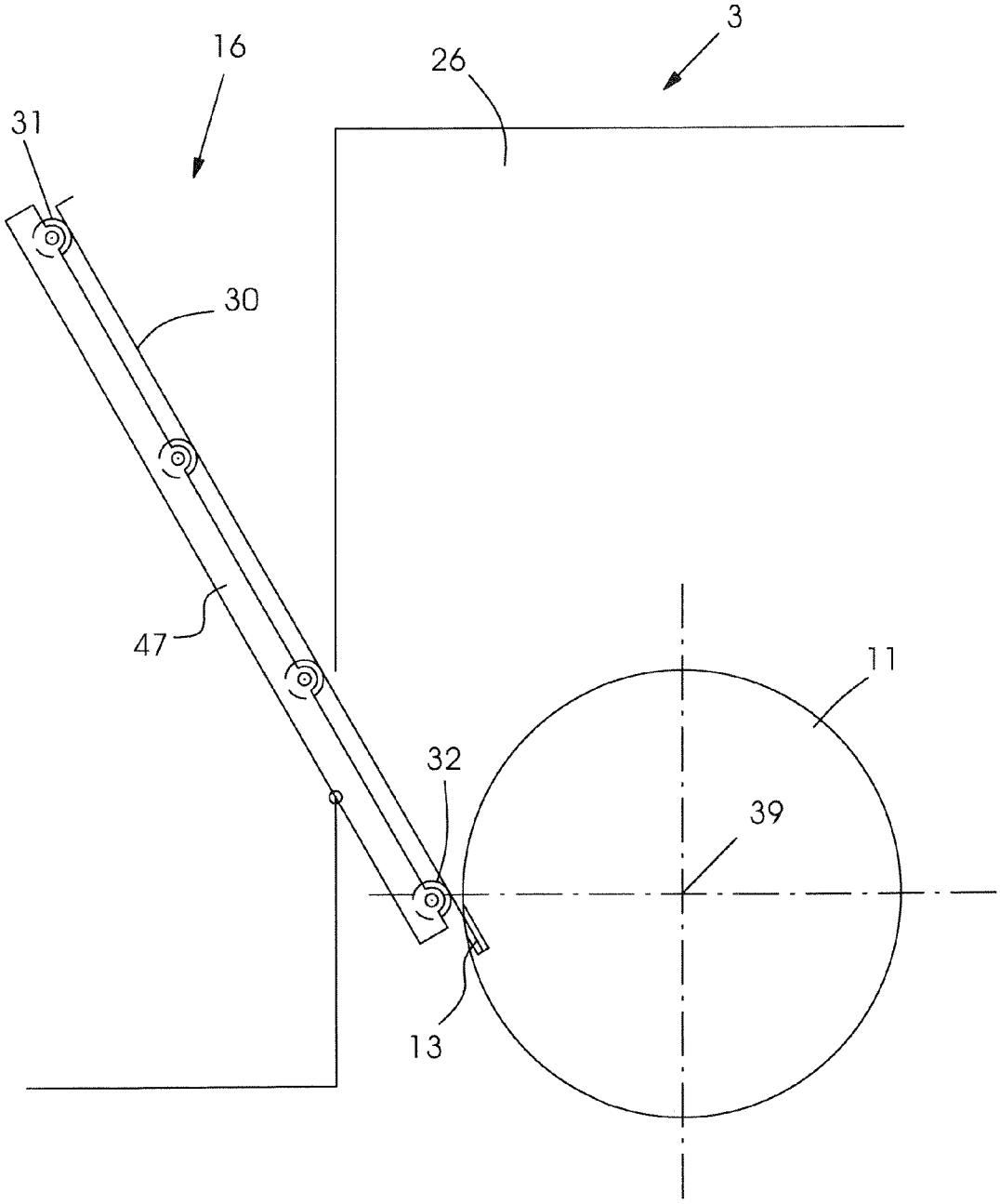
FIG. 8 is an enlarged, fragmentary, sectional view of a further exemplary embodiment of a printing plate changing device which is configured in one piece.

In one exemplary embodiment according to FIG. 8, the entire printing plate changing apparatus 16 has a single piece carrier 47 which is disposed pivotably on the machine frame 26. The guiding rollers 31 for producing a convex curvature of the printing plate 30 with regard to the guiding device and a concave curvature of the printing plate with regard to the plate cylinder axis 39, are disposed at one end of the carrier 47, which end faces away from the plate cylinder 11.

The guiding rollers 32 for producing a convex curvature of the printing plate with regard to the cylinder axis 39 are disposed at an end of the carrier 47 which faces the plate cylinder 11.

All or individual guiding rollers 31, 31.1, 32 and/or 32.1 can be assigned setting apparatuses 48, as seen in FIG. 4, for setting a vertical position with regard to the guiding regions K, L, in order for it to be possible to adjust the degree of curvature.

The invention claimed is:

1. An apparatus for feeding a printing plate to a plate cylinder of a printing press, the apparatus comprising:

a pivotably disposed guiding device having a first guiding region shaped convexly relative to an axis of the plate cylinder and a second guiding region shaped concavely relative to the cylinder axis and spaced apart from said first convexly-shaped guiding region.

2. The apparatus according to claim 1, wherein said first convexly-shaped guiding region has guiding rollers.

3. The apparatus according to claim 2, wherein said guiding rollers are spaced apart next to one another, transversely relative to a printing plate feeding direction.

4. The apparatus according to claim 3, wherein at least one of said guiding rollers is adjustable in height relative to said guiding region.

5. The apparatus according to claim 2, wherein at least some of said guiding rollers are configured to be spaced apart from the plate cylinder.

6. The apparatus according to claim 1, wherein said second concavely-shaped guiding region has guiding rollers.

7. The apparatus according to claim 6, wherein said guiding rollers are spaced apart next to one another, transversely relative to a printing plate feeding direction.

8. The apparatus according to claim 7, wherein at least one of said guiding rollers is adjustable in height relative to said guiding region.

9. The apparatus according to claim 6, wherein at least some of said guiding rollers are configured to be spaced apart from the plate cylinder.

10. A method for feeding printing plates to a plate cylinder of a printing press, the method comprising the following steps:

feeding a front edge of a printing plate to a clamping device of the plate cylinder for the front edge of the printing plate;

applying a curvature extending convexly relative to an axis of the plate cylinder to the printing plate in vicinity of the front edge of the printing plate before closing the clamping device for the front edge of the printing plate; and applying a curvature extending concavely relative to the plate cylinder axis to the printing plate in a rear region of the printing plate being spaced apart from the vicinity of the front edge.

* * * * *